United States Patent [19]

Papworth et al.

[11] Patent Number: 4,659,254

[45] Date of Patent: Apr. 21, 1987

[54] MARINE UNITS

[75] Inventors: Charles D. Papworth, Sandford; Andrew L. Pole, Langford; Arthur L. Brake, Winscombe; Ivan H. Dimmock, Worle, all of England

[73] Assignee: BAJ Limited, Great Britain

[21] Appl. No.: 766,131

[22] Filed: Aug. 15, 1985

[30] Foreign Application Priority Data

Aug. 16, 1984 [GB] United Kingdom ..... 8420852

[51] Int. Cl.[4] ..... E02D 23/02

[52] U.S. Cl. ..... 405/205; 405/224; 405/195; 114/293; 441/32

[58] Field of Search ..... 405/195, 203, 204, 205, 405/224; 114/293, 294, 295; 441/7, 32, 33

[56] References Cited

U.S. PATENT DOCUMENTS 3,290,642 12/1966 Mason ..... 441/33
3,516,489 6/1970 Jergins ..... 175/7
3,653,355 4/1972 Christians et al. ..... 114/295
4,543,904 10/1985 Puoti ..... 114/294

FOREIGN PATENT DOCUMENTS 0178022 11/1982 Japan ..... 405/195
12092 of 1914 United Kingdom ..... 405/224

*Primary Examiner*—Cornelius J. Husar
*Assistant Examiner*—Kristina L. Hall
*Attorney, Agent, or Firm*—Ralph R. Rath

[57] ABSTRACT

A marine unit for location on the sea bed has a cylindrical body and legs which are connected to the body by a pivot adjacent one end of the body. Each leg has a toothed member which engages a common worm driven by a motor. The legs are connected by webs of net. The body and nets nest within the legs for storage, the legs are partly opened for the descent, and are opened fully when the unit reaches the sea bottom to support the unit with its axis approximately vertical.

14 Claims, 2 Drawing Figures

MARINE UNITS

Technical Field

This invention relates to marine units and is particularly concerned with the deployment on and support from the sea bed of units to be located thereon. The invention is particularly concerned with elongate units to be mounted with their axes approximately vertical. The units may serve various purposes but in general the invention is concerned with relatively small units, for example units of less than ten or more preferably less than five metres in height and is particularly concerned with units which, when in use, are totally submerged, for example at depths of some tens or some hundreds of meters. The units may, for example, incorporate electronic equipment such as navigation equipment.

SUMMARY OF THE INVENTION

The positioning of marine units in a desired orientation on the sea bed presents problems and it is an object of the present invention to overcome such problems. This is achieved in accordance with the invention by providing that each leg is connected to the body by a pivot at or adjacent one end of the body of the unit and is arranged to be pivoted from a position adjacent to the body to a deployed position extending away therefrom. Each arm may be spring loaded but preferably the unit includes power means for deploying the legs. Each leg may be provided with its own actuator but preferably there is an actuator common to some or all of the legs and in one particular arrangement each leg carries an arcuate toothed member, all the toothed members engaging a common worm connected to a motor.

Each of the legs may be concave on the side facing the body of the unit, the body nesting within the legs when the legs are in their retracted position, and where the body is in the form of a circular cylinder each leg may be arcuate in cross section, the radius of the inner surface of the leg being approximately equal to that of the outer surface of the body, in the retracted position the body nesting within the legs. Preferably the circumferential dimension of each leg and the number of legs is such that the body is substantially totally surrounded by the legs when the legs are in their closed position.

The outer surfaces of the legs are preferably convex and where the inner surfaces are arcuate the outer surfaces may be also arcuate and parallel with the inner surfaces.

The unit may include a web extending between adjacent legs of at least one pair of legs and preferably there is a web extending between each adjacent pair of legs, the web being of flexible material, for example of netting or a net of rope or other cordage. The arrangement may be such that the web or webs may be enclosed between one or more of the legs and the body of the unit when the legs are in the closed position.

One or more of the legs may include anchoring means for securing the leg to the sea bed. For example the anchoring means may comprise a drivable bolt or spike and driving means such as a gas generator or other protechnic device. The or each spike may include means for injecting a hardenable substance such as resin through the spike to more securely anchor the spike.

The unit may be arranged so it may be delivered to the surface of the water with the legs full closed and may include means for partially opening the legs, for example so that their longitudinal axes are at approximately 20° to the longitudinal axis of the body, during descent of the device to the sea bed and directional means such as a drogue may be employed to control the sinking movement. The unit may include means for producing progressive opening of the legs either on receipt of a signal or on impact with the sea bed. The effect of opening the legs will be to tend to move the unit into an upright position. If one or more of the legs encounters a protruberance such as a boulder there will be a tendency for the leg to slide off the protruberance and to move the whole unit away from the protruberance. The unit may include means for sensing its attitude when the deployment of the legs has been completed and for closing the legs and reopening the legs if the attitude departs by an amount greater than a predetermined value from the vertical. It is probable that during the closing and reopening the unit will be moved away from its initial position to a position where it will achieve the desired verticality.

The invention ma be carried into practice in various ways and one marine unit embodying the invention will now be described by way of example with reference to the accompanying drawings.

BRIEF DESCRIPTION OF GENERAL VIEWS OF DRAWINGS

DETAILED DESCRIPTION

Figure 1:
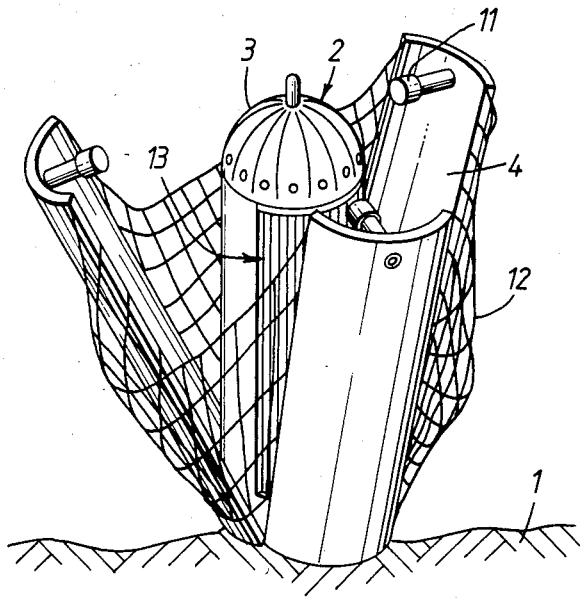
FIG. 1 is a perspective view of the unit.
Figure 2:
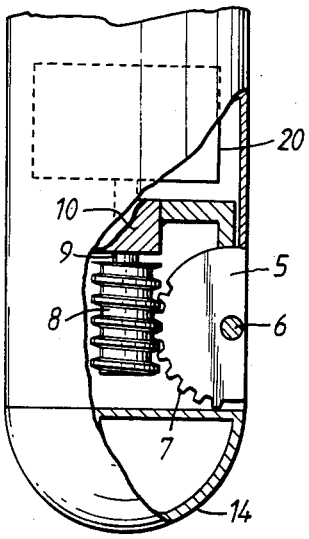
FIG. 2 is a side elevation to a larger scale of the bottom part of the body of the unit showing certain portions broken away.

While this invention is susceptible of embodiment in many different forms, there is shown in the drawings and will herein be described in detail a preferred embodiment of the invention with the understanding that the present disclosure is to be considered as an exemplification of the principles of the invention and is not intended to limit the broad aspect of the invention to the embodiment illustrated.

The marine unit shown in the drawings is intended to be deployed on the sea bed 1 and has a body 2 in the form of an elongate circular cylinder with an upper dome 3 and a lower dome 14 and intention being that the unit shall stand on the sea bed 1 with the axis of the body 2 approximately vertical. The unit includes three legs 4 each of which is in the form of an elongate part circular cylinder having a length slightly greater than the length of the body, the three legs together making up substantially a complete cylinder having an internal radius slightly greater than the external radius of the body 2. At its lower end each leg carries a lug 5 carrying a pivot pin 6 which is pivoted to the body for rotation about an axis perpendicular to the longitudinal axis of the body. Each lug 5 is formed with quadrant teeth 7 which engage a worm 8 whose axis coincides with the longitudinal axis of the body 2. The worm is mounted on a shaft 9 passing through a bearing 10 and connected to a motor 20.

Adjacent the outer end of each leg there is an optional anchoring device 11 which is arranged on operation to drive a trapped pin into the sea bed by the generation gas pressure. The anchoring devices project inwardly and are arranged to overlie the domed upper end 3 and are at different levels so that they do not interfere with one another.

Connecting adjacent legs are webs formed by nets 12. These are normally housed between the legs and the body when the legs are in their closed position.

The body of the unit carries an appropriate payload 13.

The unit is conveyed to the point where it is required with the legs 4 closed about the body 2 with the nets 12 enclosed by the legs. The unit then travels to the sea bed either freely or under control and, as mentioned before, during its descent the legs are partially opened to the position shown in FIG. 1 by operation of the motor 20. The legs provide protection to the body 2 during storage and transport but when opened to the position shown in FIG. 1 they aid stability and moreover assure that the body 2 is at least partially upright when the unit first reaches the sea bed. On reaching the sea bed the motor 20 is further actuated to deploy the legs fully until they extend perpendicularly from the longitudinal axis of the body 2. Provided that the sea bed is level and smooth the axis will then be vertical. If one of the legs encounters an obstruction there will be a tendency for the leg to move off the obstruction as deployment proceeds but if this does not occur and the unit is excessively tilted this will be sensed and the legs will close up again and will reopen. This closing and opening of the legs will produce some lateral movement of the unit and the unit may then achieve its desired vertical position. If not, closing and opening may occur again.

The webs between the legs will improve the stability of the unit when first deployed. After a period of time, debris will become moved over the webs by water currents thus further improving stability, avoiding lateral movement of the unit and resisting erosion of the sea bed around the unit by currents.

We claim:

1. A marine unit having an elongated body and a plurality of legs, each said leg being connected to said body by a pivot adjacent one end of said body and each said leg being pivotable from a closed position adjacent to said body to a deployed position extending away from said body, each of said leg being concave on the side facing said body, and said body nesting withing said legs when the legs are in said closed position.

2. A unit according to claim 1 further comprising power means connected between said body and said legs for deploying said legs.

3. A unit according to claim 2 wherein said power means comprises an actuator common to at least a plurality of said legs.

4. A unit according to claim 3 wherein said actuator comprises a motor, said motor is connected to drive a worm, and each said leg carries an arcuate toothed member engaging said worm.

5. A unit according to claim 1 wherein said body is configured as circular cylinder and each said leg is arcuate in cross section, the radius of the inner surface of said leg being approximately equal to the radius of the outer surface of said body, said body in said closed position of said legs nesting within said legs.

6. A unit according to claim 5 wherein said body is substantially totally surrounded by said legs when said legs are in said closed position.

7. A unit according to claim 1 further including a web of flexible material extending between adjacent ones of said legs.

8. A unit according to claim 7 wherein said web is a net.

9. A unit according to claim 7 wherein said web is enclosed between said legs and said body when said legs are in said closed position.

10. A unit according to claim 1 wherein at least one of said legs includes anchoring means for securing the leg to the sea bed.

11. A unit according to claim 1 wherein said legs are adapted to adopt three possible positions: (A) fully closed for storage; (B) partially opened for descent; and (C) fully opened for support of said body from sea bed.

12. A marine unit comprising:

an elongated body having an upper end and a lower end;

a plurality of legs each having an inner end and an outer end, each leg being pivoted adjacent its inner end to said body adjacent said lower end of said body;

a flexible web connecting each adjacent pair of legs;

power means operatively connected between said body and said legs, whereby said legs are pivotable from a closed position in which said legs extend alongside said body to an open position in which said legs extend away from said body, said legs having an inner side and an outer side, said inner side being concave, whereby when said legs are in said closed position said body is nested within said legs with said webs enclosed between said legs and said body.

13. A marine unit having an upright generally cylindrical body and a plurality of legs, each said leg having one end thereof connected to said body adjacent the lower end of said body by a pivot, actuator means in said body and operatively connected to said legs to pivot said legs simultaneously from a closed upwardly-extending position adjacent to said body to a deployed position extending away from said body.

14. A unit according to claim 13 wherein said actuator means comprises an actuator common to at least a plurality of said legs.

* * * * *